United States Patent [19]

Culling

[11] Patent Number: 4,981,646

[45] **Date of Patent: * Jan. 1, 1991**

[54] CORROSION RESISTANT ALLOY

[75] Inventor: John H. Culling, St. Louis, Mo.

[73] Assignee: Carondelet Foundry Company, St. Louis, Mo.

[ * ] Notice: The portion of the term of this patent subsequent to Aug. 23, 2005 has been disclaimed.

[21] Appl. No.: 339,501

[22] Filed: Apr. 17, 1989

[51] Int. Cl.[5] ..... C22C 30/02

[52] U.S. Cl. ..... 420/582; 420/586.1

[58] Field of Search ..... 420/582, 586.1

[56] References Cited

U.S. PATENT DOCUMENTS

| | | | |
|---|---|---|---|
| 2,777,776 | 1/1957 | Kieras | 106/272 |
| 3,726,668 | 4/1973 | Bäumel | 420/45 |
| 3,811,875 | 5/1974 | Goda, Jr. et al. | 420/582 |
| 4,078,920 | 3/1978 | Liljas et al. | 420/582 |
| 4,135,919 | 1/1979 | Culling | 420/582 |
| 4,141,762 | 2/1979 | Yamaguchi et al. | 420/584 |
| 4,172,716 | 10/1979 | Abo et al. | 420/41 |
| 4,201,575 | 5/1980 | Henthorne et al. | 420/582 |
| 4,400,349 | 8/1983 | Kudo et al. | 420/582 |
| 4,487,744 | 12/1984 | DeBold et al. | 420/582 |
| 4,765,957 | 8/1988 | Culling | 420/582 |
| 4,795,610 | 1/1989 | Culling | 420/582 |
| 4,818,483 | 4/1989 | Culling | 420/582 |
| 4,824,638 | 4/1989 | Culling | 420/582 |
| 4,836,985 | 6/1989 | Culling | 420/582 |
| 4,840,768 | 6/1989 | Culling | 420/582 |

*Primary Examiner*—John P. Sheehan
*Assistant Examiner*—David W. Schumaker
*Attorney, Agent, or Firm*—Senniger, Powers, Leavitt & Roedel

[57] ABSTRACT

The present invention is directed to air-meltable, castable, workable alloys resistant to hot or cold chlorides and variety of chemical streams. The alloys consist essentially of, by weight, between about 20% and about 24% nickel, from about 22% to about 25% chromium, from about 5% to about 7% molybdenum, from about 0.7% to about 3.5% copper, up to about 0.08% carbon, up to about 0.35% nitrogen, up to about 0.8% columbian (niobium), up to about 1.5% manganese, up to about 1% silicon, and the balance essentially iron. Up to about 0.3% cobalt can also be present as an element naturally coexisting in certain ore deposits as a sister element to nickel and considered here to be part of the nickel content. The alloys of the present invention are of single phase austenitic matrices.

6 Claims, No Drawings

CORROSION RESISTANT ALLOY

BACKGROUND OF THE INVENTION

This invention relates to stainless steel alloys having excellent mechanical and corrosion resistant properties in which the nickel content is lower than prior art alloys having substantially equal corrosion resistance.

For centuries the principal metals employed in the manufacture of small arms were brasses, bronzes, iron and pack-carburized carbon steel for springs and other hardened components. Products of combustion of the black gunpowder employed at that time as propellant included nitrates and sulfates, both of which in conjunction with the moisture from the air, caused rusting of the iron and steel if not removed within a matter of hours. The brasses and bronzes did not corrode rapidly, but were relatively scarce, expensive and unsuited for most gun parts due to their low static and impact strengths.

By the time of the American Civil War, the flinlock method of ignition had been almost entirely supplanted by the percussion system in which the percussion primer caps contained chlorates to ignite the gunpowder. During ignition, these chlorates formed chlorides, which were even more corrosive to iron and steel than were the combustion products of the black powder itself.

During most of this period bluing and browning methods were employed to provide very thin coatings of iron oxides on the surfaces of iron and steel parts. Such coatings were more cosmetic than protective and would quickly rust through into the base metal if the guns were not quickly cleaned after firing with hot, perhaps soapy, water.

The Spencer rifles and carbines of the Civil War had their receivers coated with a thin layer of tin to help prevent attack of the metal on the outside surfaces. This of course did nothing to protect the bare and inside surfaces and working parts of the guns.

In the early part of the twentieth century, stypnates and other compounds were discovered to replace the earlier substances as priming compounds. Black gunpowder had also been replaced by other propellant compounds, so that the sources of corrosion caused by the firing of the guns themselves had been practically eliminated. However, the older corrosive priming compounds are still employed in many countries of the world for various reasons and may often be used by NATO forces. Even during the black gunpowder era, nickel coating of steel had been attempted in order to protect gun surfaces somewhat from rusting. However, the nickel coatings were relatively soft, somewhat permeable and not suitable for coating the bores of the weapons, but they did impede rusting due to the chlorides that come from human skin during handling of the weapons. On the other hand, such coatings eventually allow corrosion, especially in salt air, will sometimes come off when cleaned by certain powder fouling solvents and abrade away, e.g., by holster wear.

Chromium coatings of steel chambers, bores and bolt facings have also been employed, but these present certain problems. They are difficult to apply in even coatings, they may flake off in time, and they do present some buildup of thickness on the steel surfaces so that machining allowances must be made. The chromium coating of entire surfaces of gun parts is complicated, time consuming and not entirely successful.

Phosphate conversion coatings, referred to as Parkarizing, were employed during World War II for the protection of outside surfaces of small arms. Such coatings are generally more resistant to corrosion than bluing or browning, but they cannot be employed for internal working parts and will soon fail in the presence of chlorides.

Organic coatings have also been employed for exterior surfaces of steel parts. These coating are tough and corrosion resistant for exterior surfaces but are unsuitable for protection of bores and most internal parts and are relatively thick.

In addition to their susceptability to corrosion, steels also fail in time in rifle and machine gun barrels, and to a much lesser extent in pistol barrels, due to the erosion caused by the firing of the weapons. The burning of modern propellants causes the formation of compounds of nitrogen and carbon at very high temperatures. In rifles and machine guns maximum chamber pressures and temperature are of the order of 50,000 psi and 5,000° F. For example, under these intense temperatures and pressures, nitrogen from the propellant combustion products combines chemically with the interior bore metal to form extremely hard, brittle layers of iron nitride. These nitride surface layers, during repeated firings, are subjected to stresses beyond their endurance limits. As a result, these nitride layers eventually flake off and are replaced by renewed layers, with the gradual removal of base metal for a distance of one or more inches just forward of the cartridge chamber. Weapon accuracy eventually deteriorates after about 10,000 rounds in rifle barrels. The temperatures of steel barrels under sustained full-automatic fire climb rapidly and accelerate the nitride deterioration. Police and military service pistol barrel life will vary from about 12,000 to 20,000 rounds under the best conditions.

In the Vietnam era, the United States light weight all-purpose M-60 machine gun was produced with a chromium-plated barrel bore and a six-inch investment-cast insert at the rear of the barrel made of an alloy of nominally 60% Co—27% CR—5.5% Mo—3% Ni—3% Fe—0.25% C. While this alloy was reported to give exceptionally long barrel life under sustained fire, it is not suitable for a variety of gun parts and is very expensive and difficult to fabricate.

The twelve to fourteen percent chromium stainless steels have been employed in rifles, pistols and shot guns. It is a well established fact that large quantities of nickel, cobalt, and chromium and smaller amounts of molybdenum, columbium (niobium) and silicon, tend to retard the carburizing and nitriding processes. Even these low chromium levels are slightly efficacious in improving rifle and machine gun barrel life. However, the main reason for employing these stainless steels has been their beneficial effect upon corrosion retardation. While the 12% Cr-type stainless steels are a significant improvement in this capacity, they fail where most needed. Specifically, they are depassivated by chlorides and are subject to pitting and crevice corrosion attack if allowed to remain in the presence of chloride for even short periods. Hence, these steels are not as well suited as hoped for in service that encounters salt water or even salt air such as for some police units, navy or other military units operating in or transported through salt or brackish water conditions. Even undercover officers and operatives who have cause to carry pistols in a manner that would encounter human perspiration would welcome weapons that were made of metals that truly resist chlorides. In all of these instances, the concentrations of chlorides may become quite high due to repeated wetting and drying, since these salts do not evaporate. Even in semiautomatic firing gun parts may become quite hot, so that chloride corrosion is accelerated by the heat.

Recently, the Glock 17 model pistol was developed and manufactured in Austria. The receiver and several of its parts are injection molded of high strength plastic, which is totally resistant to all common causes of corrosion including chlorides. There are several metallic parts in the mold at the time of injection, so that these become part of the final receiver. These parts as well as the slide, barrel and other components are all formed of steel, which is again susceptible to the various forms of corrosion.

Titanium, because it is totally immune to corrosive action by seawater or other chlorides, would appear to be a good choice for various weapons. It is, however, a very tough metal, quite difficult to fabricate and machine, and considerably less dense than steel. Titanium's low density results in a lighter weapon but one having heavier recoil. Even in the case of revolvers, which are of much simpler design than semiautomatic or automatic weapons, the sheet metal forming and welding practices employed in the manufacture of modern military weapons would be impractical to employ using titanium. Nevertheless, a revolver made almost entirely of titanium alloy has recently been introduced. The cylinder is machined from solid bar stock, while the frame and barrel are vacuum investment castings. Thus, while titanium may eventually be employed in some small arms parts, it is relatively too expensive and difficult to fabricate for general use at present.

Binder, U.S. Pat. No. 2,777,766, revealed alloys resistant to many corrosive materials, including dilute chloride solutions at or near room temperature. However, Binder's alloys do not resist hotter or more concentrated chlorides, possibly because they contain columbium, which is now known to lower chloride resistance. Henthorne, et al., U.S. Pat. No. 4,201,575, and DeBold, et al., U.S. Pat. No. 4,487,744, both disclose, in a sense, derivatives of the alloys of Binder. Henthorn's alloys were specifically developed to resist acid chlorides, but are not resistant under the conditions employed in the ASTM G-48 ferric chloride test at room temperature nor either the ASTM A 262-C boiling nitric acid test in the as cast condition or when sensitized at 1400° F. for five minutes. In addition, the alloys developed by Henthorn are somewhat unbalanced and readily form sigma phase, which is quite detrimental to chloride corrosion resistance. Hence, those alloys are not well suited for many gun parts which are prepared by precision casting or forming and welding. Those alloys also have yield strengths that are too low for casting purposes.

DeBold in turn attempted to avoid the tendency of the alloys of Henthorn to form sigma phase. While the alloys of U.S. Pat. No. 4,487,744 possess resistance to a broad spectrum of corrosive agents, many of them also display poor resistance in the ASTM G-48 ferric chloride test at room temperature. Those alloys that best resist crevice corrosion at room temperature do not fare well in the pitting tests at 100° F., and vice versa. Furthermore, the alloys of U.S. Pat. No. 4,487,744 must be solution annealed at about 1950° F. and water quenched to develop their chloride resistance. Also, they have yield strengths which are too low for precision cast parts.

My own alloys of U.S. Pat. No. 4,765,957 may be formulated to have higher yield strengths than the alloys discussed above and resist seawater quite well, but they have a tendency to form sigma phase and do not resist chlorides at higher concentrations and higher temperatures.

My copending application, Ser. No. 176,409, filed Apr. 1, 1988, describes iron-based alloys of generally lower molybdenum and copper contents than the alloys of U.S. Pat. No. 4,765,957, in which nickel plus cobalt contents must exceed chromium contents by at least about 2% by weight. However, even these alloys generally have yield strengths that are too low for cast gun parts except when molybdenum contents are at a maximum, in which case there is a tendency for the austenite to destabilize and form sigma phase.

My copending application, Ser. No. 947,427 filed Dec. 29, 1986, describes an iron-base alloy of approximately 18% Cr, 7.5% Mo and certain other elements. While those alloys are superior in many ways to the alloys of Liljas, et al., U.S. Pat. No. 4,078,920, and Rossomme, et al., U.S. Pat. No. 4,421,557, all three alloys being of somewhat similar chemical compositional ranges, all three alloys still fail badly in the ASTM G48 ferric chloride test whether in the as cast condition or after welding without drastic post-weld solution annealing and quenching.

Baumel, U.S. Pat. No. 3,726,668, discloses welding rod filler alloys claiming very broad ranges of nickel, chromium and molybdenum, with the optional addition of copper. Baumel claims such weld materials provide excellent resistance to fluids which contain chloride ions. Baumel's actual examples present the welding of type 317 stainless steel and of type 317 stainless steel with a small addition of titanium, using filler rods made up of virtually type 317 stainless steel, except that the molybdenum contents are 4.3% and 4.2% instead of the 4% found in standard type 317. By today's standards, such alloys are considered to have very inferior resistance to seawater or similar chloride solutions. Baumel gives preferred compositional ranges of 15.0–20.0% chromium, 10.0–16.0% nickel and 3.5–5.0% molybdenum with what amounts to optional copper contents of 0.01–1.5%. While Baumel's exemplary alloys would also be essentially austenitic, most of the alloys represented by his claimed ranges of elements would contain large amounts of sigma or other additional undesired phases.

Yamaguchi, et al. U.S. Pat. No. 4,141,762, provides for two-phase alloys having a high manganese content, none of which have much resistance to any but the weakest chloride solutions. In the ferric chloride test of ASTM G-48, such two-phase alloys fail catastrophically in less than three days.

Goda, et al., U.S. Pat. No. 3,811,875, claims very broad contents of nickel and chromium but optional molybdenum contents only up to 3.5%. Abo, et al. U.S. Pat. No. 4,172,716, also claims broad ranges of many elements, including nickel and chromium but makes molybdenum and copper contents optional. Kudo, et al., U.S. Pat. No. 4,400,349, is somewhat similar in claiming broad ranges of nickel and chromium and in making molybdenum and copper optional additions.

Thus, there has remained a need for ductile, strong, weldable, readily fabricable alloys that are resistant to hot chloride solutions as well as ordinary corrosive substances as are found in air and water. The alloys of this invention are directed toward that end, although they also have excellent resistance to a variety of other substances.

More particularly, a need has remained in the art for alloys of relatively low cost and ease of fabrication that can be used in the manufacture of small arms employing corrosive cartridge primers and which are immune to corrosion in the presence of hot chlorides.

SUMMARY OF THE INVENTION

Among the several objects of the present invention, therefore, may be noted the provision of improved alloys resistant to chlorides, the provision of such alloys which are exceptionally fabricable and weldable; the provision of such alloys which may be melted and poured in air into ingots for fabrication or directly into precision mold castings; the provision of such alloys which may be economically formulated with relatively low proportions of strategic metals such as nickel, chromium and molybdenum; the provision of such alloys whose strategic metal contents are sufficiently low that they may be readily formulated from such relatively low-cost raw materials as scraps, ferro alloys or other commercial melting stock; the provision of such alloys which can be cast or wrought; the provision of such alloys which have low hardness and high ductility so that they may be readily rolled, forged, welded or machined; the provision of such alloys which may have higher hardness and yield strengths for direct casting into end shapes; the provision of such alloys that do not require heat treatment before or after welding, machining or forming; the provision of such alloys which resist pitting attack, crevice corrosion attack, stress corrosion cracking failure, intergranular attack and broad surface attack by fluids containing chlorides but at the same time resist a broad spectrum of corrosive substances. This invention, therefore, provides alloys suitable for employment in chemical process equipment as well as small arms for use by military and police units under the severest of conditions. Because the alloys of the invention are air-meltable and air-castable and possess advantageous mechanical properties, they are suitable as materials of construction of all metallic shapes and parts, particularly small arms parts.

Briefly, therefore, the present invention is directed to air-meltable, castable, workable alloys resistant to hot or cold chlorides and a variety of chemical streams. The alloys consist essentially of, by weight, between about 20% and about 24% nickel, from about 22% to about 25% chromium, from about 5% to about 7% molybdenum, from about 0.7% to about 3.5% copper, up to about 0.08% carbon, up to about 0.35% nitrogen, up to about 0.8% columbium (niobium), up to about 1.5% manganese, up to about 1% silicon, and the balance essentially iron. Up to about 0.3% cobalt can also be present as an element naturally coexisting in certain ore deposits as a sister element to nickel and considered here to be a part of the nickel content. The alloys of the present invention are of single phase austenitic matrices.

DESCRIPTION OF THE PREFERRED EMBODIMENT

In accordance with the present invention, alloys are provided which are immune to seawater and resist high concentrations of hot chlorides as well as a wide variety of chemical streams. However, unlike prior art alloys of similar resistance to hot or cold chloride, the alloys of the present invention may contain less nickel than chromium.

The nickel levels in the alloys of this invention are such as to maintain a single-phase, austenitic matrix crystalline structure. In part, the exceptional corrosion resistance of these alloys is due to careful control of the nickel content within a fairly narrow range. However, because the amounts of the other constituent elements are also held to narrow ranges and balanced in content with each other, resistance to hot chlorides has been maintained to a far greater extent than all other prior art alloys of such low nickel contents. As determined in comparative tests, many of the prior art alloys described above, in which nickel contents are lower than the chromium levels, have inferior resistance to chlorides than do the alloys of the present invention. Actually, alloys of the present invention have a resistance to many corrosive streams that is equal to or superior to the corrosion resistance of many prior art alloys of very much higher nickel contents.

The chromium levels of the alloys of the present invention are also quite narrow but are sufficient, in combination with the narrow molybdenum range of the instant alloys, to resist attack in the severe ferric chloride test of ASTM G-48. On the other hand, higher contents of either element, present with the relatively low nickel contents of the alloys of the invention, tend to cause the formation of sigma phase after some condition of heat treatment.

High manganese contents of themselves have never been shown to enhance chloride resistance significantly. However, high amounts of manganese have principally been employed for reasons of helping to achieve certain metallurgical structures or mechanical properties. In the alloys of the present invention it has been found desirable to limit manganese to 1.5% maximum and preferable to even further limit it to about 0.8% maximum.

Silicon is also widely known as a deoxidizer and is thus similar to manganese, but silicon is also a powerful ferrite and sigma former and must be held in the present invention to a maximum of about 1% and preferably less than about 0.7%.

Copper even in such small amounts as about 0.7% enhances the resistance of alloys of the present invention to many corrosive substances. It must not, however, exceed the solid solubility limit and therefore is held to a maximum of about 3.5% in the present invention.

Carbon in the present invention is held to a maximum of about 0.08% for unwelded and cast parts, for example for small arms, but should be held below about 0.05% maximum and preferably below about 0.027% maximum for welded parts if no columbium (niobium) is intentionally added or if no solution anneal is to be performed after welding. Columbium should be intentionally added in the amount of eight times the carbon content if carbon exceeds 0.027% and welding is to be accomplished without subsequent heat treatment. Otherwise columbium need not be present, and, in any event, should not exceed about 0.8% because of its detrimental effect upon chloride resistance.

It is well recognized that fully austenitic low carbon alloys may be cold worked to greatly increase tensile and yield strengths while maintaining adequate elongations. Such cold working is desirable in the production of such small arms components as barrels, cylinders, slides, springs or other highly stressed components.

However, when lower stressed cast parts are to be formed, it is desirable to achieve higher yield strengths and hardnesses than found in low-carbon, low-nitrogen annealed austenitic alloys. Since carbon levels of the present invention are restricted to about 0.08% maximum and preferably less, nitrogen is intentionally added to increase the strength and hardness of cast products but must not exceed the solid solubility limit of about 0.35% by weight. Such nitrogen levels coupled with the relatively low nickel contents and high chromium and molybdenum contents of the present allows yield strengths up to about 50,000 psi and hardnesses of about 190 BHN to be achieved in the as-cast products. Higher strengths and hardnesses may be obtained by aging for periods of the order of ten hours at temperatures near 1400° F.

Aluminum is known to retard carburization in heat resistant alloys, but the major alloying component that reduces barrel life in rifle and machine gun barrels is nitrogen. The alloys of the present invention have excellent resistance to nitriding by hot gasses. Aluminum is a very powerful ferrite and sigma former and as such is undesirable in alloys of the present invention. If present, aluminum should not be present in any amounts greater than the amount usually recovered from employing four ounces to four pounds of aluminum per ton of steel in the usual air-melting practice as a final deoxidizer. While most of the aluminum in such practice burns to oxide and is removed as a slag, the recovery of metallic aluminum in the final alloy might occur.

The essential components of the invention are:

| | |
|---|---|
| Nickel | 21–24% by weight |
| Chromium | 22–25% |
| Molybdenum | 5–7% |
| Copper | 0.7–3.5% |
| Iron | Essentially the balance |

Nominally, the alloys of the invention will also contain carbon, up to a maximum of about 0.08% by weight.

Optionally, the alloys of the invention may further contain:

Silicon up to 1.0%
Manganese up to 1.5%
Nitrogen up to 0.35%
Columbium: up to 0.8%

It has been found preferable to restrict the ranges of the alloying elements to the following ranges.

| | |
|---|---|
| Nickel | 21–23% |
| Chromium | 23–24 |
| Molybdenum | 5–6.7% |
| Copper | 1–3.5% |
| Manganese | 0.3–0.8% |
| Columbium | up to 0.6% |
| Nitrogen | up to 0.3% |
| Silicon | 0.3–0.7% |
| Carbon | up to 0.05% |
| Iron | Essentially the balance |

A particularly advantageous alloy having optimum chemical, physical, mechanical and metallurgical properties has the following composition:

| | |
|---|---|
| Nickel | 21% |
| Chromium | 23% |
| Molybdenum | 5.2% |

-continued

| | |
|---|---|
| Copper | 3% |
| Manganese | 0.4% |
| Silicon | 0.5% |
| Nitrogen | 0.15% |
| Carbon | 0.01% |
| Columbium | 0.25% |
| Iron Essentially the balance | |

In all the alloy compositions of this invention it is to be understood that the iron content can include small amounts of tramp impurities.

The following examples further illustrate the invention:

EXAMPLE 1

One hundred pound heats of several different alloys were prepared in accordance with the invention. Each of the heats was air-melted in a 100-pound high frequency induction furnace. The composition of these heats is set forth in Table 1, with the balance in each instance being essentially iron.

TABLE I

ALLOYS OF THE INVENTION
PERCENT BY WEIGHT OF ALLOYING ELEMENTS

| ALLOY NUMBER | Ni | Cr | Mo | Cu | Mn | Cb | C | Si | N | Co |
|---|---|---|---|---|---|---|---|---|---|---|
| 1432 | 20.54 | 22.57 | 6.13 | 1.07 | .61 | .01 | .01 | .64 | .20 | .00 |
| 1433 | 20.21 | 23.02 | 5.42 | 1.13 | .45 | .06 | .01 | .66 | .19 | .15 |
| 1440 | 22.66 | 22.86 | 5.28 | 1.23 .57 | .00 | .01 | .26 | .08 | .00 | |
| 1442 | 21.82 | 23.81 | 6.34 | 2.92 | .42 | .02 | .02 | .70 | .15 | .00 |
| 1443 | 21.20 | 23.03 | 5.03 | 3.06 | .44 | .06 | .01 | .65 | .15 | .16 |
| 1447 | 22.96 | 23.32 | 6.66 | 1.09 | .71 | .37 | .03 | .33 | .24 | .08 |
| 1481 | 23.61 | 24.54 | 5.23 | 1.27 | .38 | .55 | .03 | .45 | .29 | .13 |

Standard physical test blocks and corrosion test bars were prepared from each heat. Using the as cast non-heat-treated physical test blocks, four test bars from each of the heats were measured for mechanical properties. The highest and lowest values for each property of each of these alloys are set fourth in Table II.

TABLE II

Ranges of Mechanical Properties of Alloys as Cast

| Alloy Number | Tensile Strength P.S.I. | Yield Strength P.S.I. | Tensile Elongation % | Brinell Hardness Number |
|---|---|---|---|---|
| 1432 | 68–70,000 | 39–40,000 | 12–19 | 128–170 |
| 1433 | 63–83,000 | 36–41,000 | 13–32 | 138–170 |
| 1440 | 61–73,000 | 30–33,000 | 38–53 | 126–137 |
| 1442 | 81–82,500 | 39–46,000 | 36–44 | 156–163 |
| 1443 | 80–82,200 | 38–39,000 | 43.5–47 | 156–164 |
| 1447 | 78–90,000 | 41–47,000 | 21–36 | 168–183 |
| 1481 | 79–93,000 | 45–51,000 | 11–33 | 173–196 |

Without heat treatment, the corrosion test bars were machined into 1½inch diameter by ¼-inch thick discs, each having a ⅛-inch diameter hole in the center. The discs were carefully machined and then ground to a 240-grit finish and polished to a 600-grit finish.

These discs were then used in the corrosion tests described hereinafter. In some instances, the performance of these alloys with prior art alloys was compared. The compositions of the comparative alloys used in the tests are set forth in Table III. The comparative art alloys were also tested in the as cast condition.

In the corrosion comparison data, the units employed to express the corrosion depth are mils. One mil equals 0.001 inch. The rate of corrosion attack is expressed as mils per year, MPY. A corrosion rate of 4 MPY or less is generally considered to be no attack. Up to 10 MPY is often acceptable in chemical process industries.

TABLE III

| ALLOY NUMBER | COMPARATIVE ALLOYS Percent by Weight of Alloying Elements | | | | | | | | | |
|---|---|---|---|---|---|---|---|---|---|---|
| | Ni | Cr | Mo | Cu | Cb | Mn | Si | N | C | Co |
| A | 46.78 | 22.23 | 5.81 | 1.82 | 2.03 | 1.49 | 0.44 | — | .01 | 3.47 |
| B | 33.11 | 20.08 | 2.19 | 3.33 | 0.56 | 0.43 | 0.35 | — | .02 | — |
| C | 13.23 | 17.35 | 4.21 | — | — | 0.89 | 0.63 | 0.16 | .05 | — |
| D | 10.10 | 17.23 | — | 1.43 | — | 1.72 | 0.44 | — | .09 | — |
| E | 18.16 | 20.03 | 6.41 | 0.93 | — | 0.52 | 0.39 | 0.21 | .01 | — |
| F | 10.66 | 18.20 | 5.32 | — | — | 1.63 | 0.52 | 0.08 | .05 | — |
| G | 12.89 | 24.77 | 1.03 | — | 1.02 | 1.46 | 0.85 | 0.23 | .07 | — |
| H | 34.16 | 24.06 | 5.68 | 3.23 | — | 0.38 | 0.35 | — | .02 | — |
| I | 47.41 | 25.09 | 2.82 | — | — | 3.51 | 0.22 | — | .02 | — |
| J | 18.31 | 18.45 | 7.19 | 2.13 | — | 1.19 | 0.56 | 0.14 | .01 | — |
| K | 37.07 | 23.33 | 3.86 | 1.02 | 0.25 | 0.61 | 0.32 | — | .02 | — |

EXAMPLE 2

Using the disc samples of Example 1, samples of all the heats of alloys of the invention were immersed to a depth of about 1¾ inches in natural seawater taken from the Atlantic Ocean at Myrtle Beach, S.C. The seawater was held at room temperature in plastic containers with tightly-fitting lids for six months with a change of water every two weeks. At the end of this six months period none of the samples of the invention showed any pits, rust or discoloration when examined under a 10-power magnifying glass.

EXAMPLE 3

Discs from Example 1 were similarly placed in plastic containers as in Example 2 employing the same ocean water as used in Example 2 but to which had been added 30 drops of concentrated hydrochloric acid per gallon of seawater which resulted in a pH of 1.9 (distilled water registered a pH of 7.0). At the end of six months, none of the samples of alloys of the invention displayed any pits, rust or discoloration when examined under a 10-power magnifying glass.

EXAMPLE 4

Using discs of Example 1, samples of all of the heats of the alloys of the invention plus samples of all of the comparative alloys were tested at 23° C., in accordance with the procedure of Method A of ASTM STANDARD G48-76 (Reapproved 1980) for testing pitting resistance of alloys by the use of ferric chloride solution. In accordance with the test specifications each sample was held for 72 hours in a glass cradle immersed in 600 ml of ferric chloride solution held in a 1000-ml beaker covered with a watch crystal. The ferric chloride solution was prepared by dissolving 100g of reagent grade ferric chloride, $FeCl_3.6H_2O$, in 900 ml of distilled water (about 6% $FeCl_3$ by weight).

Each disc was carefully weighed to the nearest 10,000 th of a gram before exposure. After 72 hours of exposure each specimen was rinsed with water, scrubbed with a nylon bristle brush under running water to remove corrosion products, soaked in 1000 ml of hot tap water at a temperature of 80° C. for about an hour to leach out any chloride solution remaining in any pits, re-rinsed, and then dried on a hot plate for an hour at about 80° C. Each specimen was then reweighed again to the nearest 10,000th of a gram and the weight loss was recorded. For convenience of comparison the weight loss was converted to a figure of average depth of penetration in MPY (mils per year) in accordance with this relationship:

$$MPY = 393.7 \frac{Wo - Wf}{ATD}$$

where,

Wo=Original weight of sample

Wf=Final weight of sample

A=Area of the test sample in square centimeter

T=Duration of the test in years

D=Density of the alloy in grams per cubic centimeter

This method of presenting data is not a true indication of maximum depth of attack or penetration, because in cases of severe attack penetration at pit sites may reach depths of a tenth of an inch or more. Nevertheless, it gives a comparison of severity of attack. The test results of the three-day exposures are set forth in Table IV.

TABLE IV

| Average MPY Loss in 6% Ferric Chloride at 23° C. | | | |
|---|---|---|---|
| Alloys of the Invention | | Comparative Alloys | |
| 1432 | 0.1 | A | 0.8 |
| 1433 | 0.1 | B | 1.9 |
| 1440 | 0.2 | C | 168.7 |
| 1442 | 0.1 | D | 596.6 |
| 1443 | 0.2 | E | 10.4 |
| 1447 | 0.1 | F | 228.3 |
| 1481 | 0.1 | G | 436.8 |
| | | H | 1.6 |
| | | I | 212.7 |
| | | J | 318.1 |
| | | K | 10.5 |

EXAMPLE 5

Test discs of this invention and of several comparative alloys were suspended in flasks by platinum wires hooked through the center holes of the discs and attached to the tops of the flasks. Each disc was immersed in a solution of 25% nitric acid within the flask, and a fitted, water-cooled sealed top was installed. The acid was maintained at a boil for six hours. The test discs were then cleaned as in Example 4. Each disc was then dried and weighed again to the nearest 10,000th of a gram. The corrosion rate for each disc, in MPY, was then calculated in accordance with the formula above.

This procedure was repeated for each disc in a solution of boiling 3% sodium chloride and again in a solution of 10% sulfuric acid plus ½% nitric acid. The results of these tests are set forth in Table V.

TABLE V

| Corrosion Rate in MPY in Various Boiling Solutions | | | |
|---|---|---|---|
| Alloy Designation | 25% Nitric Acid | 3% Sodium Chloride Acids | 10% Sulfuric + 1/4% Nitric |
| 1432 | 10.8 | NIL | NIL |
| 1433 | 9.7 | NIL | 2.4 |
| 1440 | 9.3 | NIL | NIL |
| 1442 | 11.3 | NIL | NIL |
| 1443 | 8.6 | NIL | NIL |
| 1447 | 14.7 | NIL | NIL |
| 1481 | 9.2 | NIL | NIL |
| A | 3.2 | NIL | 3.1 |
| B | 7.7 | 5.8 | NIL |
| E | 48.2 | NIL | NIL |
| H | 17.7 | NIL | NIL |
| J | 69.5 | NIL | 16.7 |
| K | 11.6 | NIL | NIL |

EXAMPLE 6

Test discs of the alloys of this invention were suspended by platinum wires in 600 ml beakers containing various solutions for 24 hours each. The beakers were covered by a double watch crystals and maintained at temperature on a hot plate. The test discs were cleaned and reweighed as in Example 4 and the attach in the various substances calculated. The results of these tests are set forth in Table VI.

TABLE VI

| Corrosion Rate in MPY of Alloys of this Invention | | | | | | | |
|---|---|---|---|---|---|---|---|
| Test Solution and Temperature | 1432 | 1433 | 1440 | 1442 | 1442 | 1447 | 1481 |
| 70% Nitric Acid-80° C. | 3.4 | 3.3 | 2.8 | 3.1 | 2.7 | 3.9 | 1.6 |
| 10% Sulfuric Acid-80° C. | 1.1 | 2.0 | 0.3 | 1.5 | 0.1 | 1.8 | 0.8 |
| 25% Sulfuric Acid-80° C. | 4.2 | NIL | 1.1 | 5.8 | NIL | 3.3 | 2.8 |
| 96% Sulfuric Acid-23° C. | NIL | NIL | NIL | NIL | NIL | NIL | NIL |
| 96% Sulfuric Acid-70° C. | 5.9 | 5.4 | 6.1 | 4.9 | 7.0 | 7.7 | 7.2 |
| 10% Sulfuric + ¼% Nitric Acid-80° C. | 0.8 | 1.2 | 0.6 | 0.5 | 0.5 | 3.9 | 4.4 |
| 25% Sulfuric + ¼% Nitric Acid-80° C. | 1.5 | 1.6 | 0.8 | 0.7 | NIL | 3.1 | 3.3 |
| 40% Sulfuric + ¼% Nitric Acid-80° C. | 0.3 | 1.0 | NIL | NIL | 1.6 | 7.2 | 3.6 |

The above examples demonstrate the excellent mechanical properties for fabricability of alloys of this invention, and their imperviousness to seawater and even more aggressive chloride solutions and other aggressive chemical substances at lower nickel contents than any prior art alloys of equal or similar resistance.

As various changes can be made in the alloys of the invention without departing from the scope of the invention, it is intended that all matter contained in the above description shall be interpreted as illustrative and not in a limiting sense.

What is claimed is:

1. An air-meltable, castable, workable, weldable, machinable alloy resistant to chlorides and other corrosive substances, consisting essentially of:

| | |
|---|---|
| Nickel | 21%-24% by weight |
| Chromium | 22%-25% |
| Molybdenum | 5%-7% |
| Copper | 0.7%-3.5% |

-continued

| | |
|---|---|
| Iron | Essentially the balance |

2. An alloy of claim 1 wherein the carbon content is not greater than about 0.08% by weight.

3. An alloy of claim 2 further containing:

| | |
|---|---|
| Silicon | up to 1.0% by weight |
| Manganese | up to 1.5% |
| Nitrogen | up to 0.35% |
| Columbium | up to 0.8% |

4. An alloy of claim 3 consisting essentially of:

| | |
|---|---|
| Nickel | 21%-23%, by weight |
| Chromium | 23%-24% |
| Molybdenum | 5%-6.7% |
| Copper | 1%-3.5% |
| Carbon | up to 0.05% |
| Silicon | 0.3%-0.7% |
| Manganese | 0.3%-0.8% |
| Nitrogen | up to 0.3% |
| Columbium | up to 0.6% |
| Iron | Essentially the balance |

5. An alloy of claim 4 consisting essentially of:

| | |
|---|---|
| Nickel | 21%, by weight |
| Chromium | 23% |
| Molybdenum | 5.2% |
| Copper | 3% |
| Manganese | 0.4% |
| Silicon | 0.5% |
| Nitrogen | 0.15% |
| Carbon | 0.01% |
| Columbium | 0.25% |
| Iron | Essentially the balance |

6. An alloy of claim 3 consisting essentially of:

| | |
|---|---|
| Nickel (including up to about 0.1% Co) | 23%-23.8%, by weight |
| Chromium | 23%-24.5% |
| Molybdenum | 5.2-6.7% |
| Copper | 1%-1.3% |
| Manganese | 0.3%-0.7% |
| Columbium | 0.3%-0.6% |
| Carbon | up to 0.03% |
| Silicon | 0.3%-0.5% |
| Nitrogen | 0.2%-0.3% |
| Iron | Essentially the balance |

* * * * *